US010550635B2

(12) United States Patent
Lin

(10) Patent No.: US 10,550,635 B2
(45) Date of Patent: Feb. 4, 2020

(54) WINDOW COVERING CONTROL APPARATUS

(71) Applicant: Whole Space Industries LTD, Taipei (TW)

(72) Inventor: Tzu-Yen Lin, Taipei (TW)

(73) Assignee: Whole Space Industries LTD, Taipei (TW)

( * ) Notice: Subject to any disclaimer, the term of this patent is extended or adjusted under 35 U.S.C. 154(b) by 85 days.

(21) Appl. No.: 15/672,442

(22) Filed: Aug. 9, 2017

(65) Prior Publication Data

US 2019/0048655 A1 Feb. 14, 2019

(51) Int. Cl.

| | |
|---|---|
| ***E06B 9/322*** | (2006.01) |
| ***E06B 9/305*** | (2006.01) |
| ***E06B 9/307*** | (2006.01) |
| ***E06B 9/324*** | (2006.01) |

(52) U.S. Cl.

CPC ..... *E06B 9/305* (2013.01); *E06B 9/307* (2013.01); *E06B 9/322* (2013.01); *E06B 9/324* (2013.01); *E06B 2009/3222* (2013.01)

(58) Field of Classification Search

CPC .. E06B 2009/3222; E06B 9/322; E06B 9/323; E06B 9/324

See application file for complete search history.

(56) References Cited

U.S. PATENT DOCUMENTS

| | | | |
|---|---|---|---|
| 13,251 | A | 7/1855 | Bixler |
| 2,420,301 | A | 5/1947 | Cusumano |
| 2,580,253 | A | 12/1951 | Stuber et al. |
| 3,921,695 | A | 11/1975 | Debs |
| 4,507,831 | A | 4/1985 | McClure |
| 4,522,245 | A | 6/1985 | Anderson |
| 4,955,248 | A | 9/1990 | Lindstrom |

(Continued)

FOREIGN PATENT DOCUMENTS

| | | | |
|---|---|---|---|
| WO | 2003054335 | A1 | 7/2003 |

OTHER PUBLICATIONS

European Search Report for European Patent Application Serial No. 17207344 dated Jun. 8, 2018.

(Continued)

*Primary Examiner* — Katherine W Mitchell
*Assistant Examiner* — Jeremy C Ramsey
(74) *Attorney, Agent, or Firm* — Buchanan Ingersoll & Rooney PC

(57) ABSTRACT

A window covering includes a first rail and a plurality of non-moving elements arranged adjacent at least one spring motor positioned in the first rail. The non-moving elements contact at least one lift cord for routing of the lift cord through the first rail to increase friction incurred during motion of the lift cord(s) that takes place during height adjustment of window covering material. Non-moving members can also be positioned to contact at least one lift cord for routing of the lift cord through the first rail to increase friction incurred during motion of the lift cord(s) that takes place during height adjustment of window covering material. The non-moving elements and non-moving members can be positioned in the first rail such that they do not move relative to the first rail when the window covering is mounted and installed for use by a user to adjustably cover a window.

20 Claims, 10 Drawing Sheets

(56) References Cited

U.S. PATENT DOCUMENTS

| | | | | |
|---|---|---|---|---|
| 5,002,113 | A | 3/1991 | Georgopoulos | |
| 5,092,387 | A | 3/1992 | King et al. | |
| 5,186,229 | A | 2/1993 | Hsu | |
| 5,396,945 | A | 3/1995 | Meyer | |
| 5,482,100 | A | 1/1996 | Kuhar | |
| 6,283,192 | B1 | 9/2001 | Toti | |
| 6,308,764 | B1 | 10/2001 | Lin | |
| 6,325,133 | B1 | 12/2001 | Lin | |
| 6,571,853 | B1 | 6/2003 | Ciuca et al. | |
| 6,601,635 | B2 | 8/2003 | Ciuca et al. | |
| 6,644,372 | B2 | 11/2003 | Judkins | |
| 6,644,373 | B2 | 11/2003 | Palmer | |
| 6,761,203 | B1 | 7/2004 | Huang | |
| 6,978,822 | B2 | 12/2005 | Schoonen | |
| 7,025,107 | B2 | 4/2006 | Ciuca | |
| 7,093,644 | B2 | 8/2006 | Strand | |
| 7,117,919 | B2 | 10/2006 | Judkins | |
| 7,143,802 | B2 | 12/2006 | Strand et al. | |
| 7,159,636 | B2 | 1/2007 | Liang | |
| 7,168,476 | B2 | 1/2007 | Chen | |
| 7,178,577 | B2 | 2/2007 | Lin | |
| 7,219,710 | B2 | 5/2007 | Cheng | |
| 7,228,797 | B1 | 6/2007 | Hillman et al. | |
| 7,287,569 | B2 | 10/2007 | Lin | |
| 7,311,133 | B2 | 12/2007 | Anderson et al. | |
| 7,398,815 | B2 | 7/2008 | Liang | |
| 7,503,370 | B2 | 3/2009 | Ciuca et al. | |
| 7,624,785 | B2 | 12/2009 | Yu et al. | |
| 7,654,301 | B2 | 2/2010 | Krab et al. | |
| 7,664,748 | B2 | 2/2010 | Harrity | |
| 7,721,783 | B2 | 5/2010 | Colson et al. | |
| 7,866,367 | B2 | 1/2011 | Liang et al. | |
| 7,950,437 | B2 | 5/2011 | Lin | |
| 7,984,745 | B2 | 7/2011 | Wen et al. | |
| 8,002,012 | B2 | 8/2011 | Cheng | |
| 8,079,398 | B2 | 12/2011 | Tsukamoto | |
| 8,087,445 | B2 | 1/2012 | DeWard et al. | |
| 8,251,120 | B2 | 8/2012 | Chen | |
| 8,281,843 | B2 | 10/2012 | Yu et al. | |
| 8,662,135 | B2 * | 3/2014 | Lin | E06B 9/322 160/168.1 R |
| 8,708,023 | B2 | 4/2014 | Wu | |
| 8,910,696 | B2 | 12/2014 | Wen et al. | |
| 8,939,190 | B2 | 1/2015 | Mullet et al. | |
| 9,045,934 | B1 | 6/2015 | Lynch et al. | |
| 9,078,537 | B2 | 7/2015 | Lee | |
| 9,091,115 | B2 | 7/2015 | Mullet et al. | |
| 9,149,143 | B2 | 10/2015 | Vestal | |
| 9,181,751 | B1 | 11/2015 | Hong | |
| 9,217,282 | B2 | 12/2015 | Defenbaugh et al. | |
| 9,246,619 | B2 | 1/2016 | Hole et al. | |
| 9,272,875 | B2 * | 3/2016 | Lin | B65H 57/00 |
| 9,316,051 | B2 | 4/2016 | Toti | |
| 9,328,554 | B2 | 5/2016 | Toti | |
| 9,376,859 | B1 | 6/2016 | Deward et al. | |
| 9,410,366 | B2 | 8/2016 | Kwak | |
| 2007/0051477 | A1 | 3/2007 | Fraser et al. | |
| 2007/0056692 | A1 | 3/2007 | Nien et al. | |
| 2010/0126678 | A1 | 5/2010 | Lin | |
| 2011/0024065 | A1 | 2/2011 | Lin | |
| 2011/0061823 | A1 | 3/2011 | Lin | |
| 2011/0198044 | A1 | 8/2011 | Lin | |
| 2011/0247761 | A1 | 10/2011 | Lin | |
| 2012/0160426 | A1 | 6/2012 | Lin | |
| 2012/0175067 | A1 | 7/2012 | Lin | |
| 2012/0211180 | A1 | 8/2012 | Lin | |
| 2012/0227910 | A1 | 9/2012 | Lin | |
| 2012/0280072 | A1 | 11/2012 | Lin | |
| 2012/0305199 | A1 | 12/2012 | Lin | |
| 2013/0048233 | A1 | 2/2013 | Lin | |
| 2013/0075045 | A1 | 3/2013 | Lin | |
| 2013/0091968 | A1 | 4/2013 | Lin | |
| 2013/0126105 | A1 | 5/2013 | Lin | |
| 2013/0220561 | A1 | 8/2013 | Yu et al. | |
| 2013/0248125 | A1 | 9/2013 | Lin | |
| 2014/0083631 | A1 | 3/2014 | Huang | |
| 2015/0136336 | A1 | 5/2015 | Huang | |
| 2015/0315842 | A1 | 11/2015 | Hong | |
| 2016/0333637 | A1 * | 11/2016 | Huang | E06B 9/322 |
| 2018/0100350 | A1 * | 4/2018 | Huang | E06B 9/322 |
| 2018/0155980 | A1 * | 6/2018 | Hong | E06B 9/322 |

OTHER PUBLICATIONS

U.S. Appl. No. 15/659,943, filed Jul. 26, 2017 for Slat Tilt Mechanism for Window Coverings.

U.S. Appl. No. 15/185,400, filed Jun. 17, 2016 for Slat Control Mechanism for Blinds.

U.S. Appl. No. 15/177,575, filed Jun. 9, 2016 for Window Covering Positional Adjustment Apparatus.

* cited by examiner

WINDOW COVERING CONTROL APPARATUS

FIELD OF INVENTION

The present innovation relates to window coverings. For example, the present innovation relates to window coverings, lift cord control mechanisms for window coverings, lift cord routing mechanisms for window coverings, and methods of utilizing such window coverings and/or mechanisms.

BACKGROUND OF THE INVENTION

Window coverings can be configured so that a material is moveable to partially or fully cover a window. Window coverings such as venetian blinds can utilize slats that are tiltable. Other types of window coverings can include other types of window covering material (e.g. cordless cellular shades, cordless Roman shades, etc.). Examples of such window coverings can be appreciated from U.S. Pat. Nos. 9,410,366, 9,376,859, 9,328,554, 9,316,051, 9,246,619, 9,217,282, 9,181,751, 9,149,143, 9,091,115, 9,078,537, 9,045,934, 8,939,190, 8,910,696, 8,708,023, 8,281,843, 8,251,120, 8,087,445, 8,079,398, 8,002,012, 7,984,745, 7,950,437, 7,866,367, 7,721,783, 7,654,301, 7,664,748, 7,624,785, 7,503,370, 7,398,815, 7,311,133, 7,287,569, 7,228,797, 7,219,710, 7,178,577, 7,168,476, 7,159,636, 7,143,802, 7,117,919, 7,093,644, 7,025,107, 6,978,822, 6,761,203, 6,644,373, 6,644,372, 6,601,635, 6,571,853, 6,325,133, 6,308,764, 6,283,192, 5,482,100, 5,396,945, 5,186,229, 5,092,387, 5,002,113, 4,955,248, 4,522,245, 4,507,831, 3,921,695, 2,580,253, 2,420,301, and 13,251 and U.S. Patent Application Publication Nos. 2016/0222725, 2015/0136336, 2015/0315842, 2014/0083631, 2013/0220561, 2013/0048233, 2013/0248125, 2013/0126105, 2013/0091968, 2013/0075045, 2012/0305199, 2012/0227910, 2012/0211180, 2012/0175067, 2012/0160426, 2011/0247761, 2011/0198044, 2011/0024065, 2011/0061823, 2010/0126678, 2010/0126673, 2007/0056692, and 2007/0051477. Other examples of window coverings can be appreciated from co-pending U.S. patent application Ser. Nos. 15/659,943, 15/185,400, and 15/177,575.

Spring motors that may be employed in cordless window coverings can often include spring elements that can add substantial cost to the spring motor unit. For instance, the spring member of the spring motor unit may require use of a substantial transmission system as disclosed in U.S. Pat. No. 6,283,192 or may require use of a type of spring member that has a special construction that can be expensive to help facilitate the support of the variable load of the window covering material as that material is raised or lowered.

SUMMARY OF THE INVENTION

I have determined that a new window covering design is needed that can permit effective height adjustment of window covering material while also permitting the use of a less expensive spring element and have developed a new window covering, lift cord control mechanism, and methods of making and using the same. In some embodiments, the window covering can be configured as a cordless window covering that does not have any exposed operator cord. In other embodiments, the window covering can include exposed lift cords, an exposed operator cord and/or operator wand, and/or exposed venetian blind ladder cords or ladder tape.

Embodiments of my window covering are provided in which a window covering can includes a first rail and a lift cord control mechanism positioned in the first rail. The lift cord control mechanism can include a housing. The window covering can also include a first non-moving element positioned in the housing between an end of the housing and a lift cord retention pulley positioned in the housing. The first non-moving element can contact a first lift cord that extends from the first lift cord retention pulley. The first lift cord extend from the first lift cord retention pulley to window covering material such that the lift cord passes through that material or passes alongside that material to a second rail or to a bottom portion of the window covering material.

Embodiments of the window covering are also provided that include a first rail and a lift cord control mechanism positioned in the first rail. The lift cord control mechanism can include at least one spring motor connected between a first lift cord retention pulley and a second lift cord retention pulley. A first lift cord can extend from the first lift cord retention pulley so that the first lift cord extends from the first lift cord retention pulley to window covering material. A second lift cord can extend from the second lift cord retention pulley. The second lift cord can extend from the second lift cord retention pulley to the window covering material. A first non-moving element can be positioned in the first rail adjacent the first lift cord retention pulley such that the first lift cord contacts the first non-moving element and moves along the first non-moving element during retraction and extension of the window covering material. A second non-moving element can be positioned in the first rail adjacent the second lift cord retention pulley such that the second lift cord contacts the second non-moving element and moves along the second non-moving element during retraction and extension of the window covering material.

Embodiments of the window coverings can include a first lift cord routing mechanism positioned in the first rail adjacent a first end of the first rail. The first lift cord routing mechanism can have a first non-moving member that contacts the first lift cord such that the first lift cord moves along the first non-moving member when the window covering material is extended or retracted. Embodiments can also include a second lift cord routing mechanism positioned in the first rail adjacent a second end of the first rail. The second lift cord routing mechanism can have a first non-moving member that contacts the second lift cord such that the second lift cord moves along the first non-moving member of the second lift cord routing mechanism when the window covering material is extended or retracted. The first lift cord can be positioned adjacent the first non-moving member such that the first lift cord forms a first encirclement about the first non-moving and the second lift cord can be positioned adjacent the second non-moving member such that the second lift cord forms a first encirclement about the second non-moving member.

The first and second cord routing mechanisms can include other non-moving members. For example, the first lift cord can contact a second non-moving member of the first cord routing mechanism such that the first lift cord moves along the second non-moving member of the first cord routing mechanism when the window covering material is extended or retracted and the second lift cord can contact the second non-moving member of the second cord routing mechanism such that the second lift cord moves along the second non-moving member of the second cord routing mechanism when the window covering material is extended or retracted. The second non-moving member of the first cord routing mechanism can be located below the first non-moving member of the first cord routing mechanism in the first rail and the second non-moving member of the second cord routing mechanism can be below the first non-moving member of the second cord routing mechanism in the first rail for some embodiments. In other embodiments, the second non-moving members can be located above the first non-moving members in the first rail.

Embodiments of the window covering can also include non-moving annular structures. For example, there may be a first annular structure positioned such that the first annular structure is located between the first lift cord routing mechanism and the first non-moving element and the first lift cord can pass through a hole in the first annular structure. There may also be a second annular structure positioned such that the second annular structure is located between the second lift cord routing mechanism and the second non-moving element. The second lift cord can pass through a hole in the second annular structure.

Some embodiments of window coverings can include additional lift cords, such as third and fourth lift cords and may also include additional annular structures and/or non-moving elements. For example, a third annular structure can be positioned between the first non-moving element and the first lift cord routing mechanism and a third lift cord can extend from the first lift cord retention pulley through a hole in this third annular structure. There can also be a fourth annular structure positioned between the second non-moving element and the second lift cord routing mechanism and a fourth lift cord that extends from the second lift cord retention pulley and passes through a hole in the fourth annular structure. The third lift cord can contact and move along the first non-moving element and the fourth lift cord can contact and move along the second non-moving element as well.

The third and fourth lift cords can also extend in the first rail so that they contact one or more non-moving members of first and second lift cord routing mechanisms. For example, the third lift cord can contact a second non-moving member of the first lift cord routing mechanism such that the third lift cord moves along the second non-moving member of the first lift cord routing mechanism when the window covering material is extended or retracted and the fourth lift cord can contact a second non-moving member of the second lift cord routing mechanism such that the fourth lift cord moves along the second non-moving member of the second lift cord routing mechanism when the window covering material is extended or retracted.

There may also be additional non-moving elements in some embodiments, such as a third non-moving element and a fourth non-moving element. The third non-moving element can be positioned between the first non-moving element and the first lift cord retention pulley. The fourth non-moving element can be positioned between the second non-moving element and the second lift cord retention pulley. Lift cords can extend from the first lift cord retention pulley and contact the third non-moving element. Also, lift cords can extend from the second lift cord retention pulley and contact the fourth non-moving element.

The non-moving elements can be structures that are configured so that those structures do not rotate or otherwise move when the window covering is mounted. The position of these elements may be a fixed location within a rail after a window covering is mounted and the rail is no longer moved for transport or installation of the window covering such that the non-moving elements are non-moving relative to the rail in which they are positioned. For example, the non-moving elements can include posts, rods, bars, annular structures that are positioned so that they do not rotate or slide and do not move linearly within a rail and do not move dynamically within a rail when a window covering is mounted, structure defined within a spring motor housing, structure affixed (e.g. welded, adhered, fastened, etc.) within a rail or a housing positioned in a rail such as one or more rods, bars, annular structures, posts, and/or other type of element.

Embodiments of the window covering can be configured for use in connection with window covering material that includes a plurality of slats on ladders that are coupled to a tilt shaft positioned in the first rail. A first ladder tilt pulley can be attached to the first lift cord routing mechanism and be positioned above the first non-moving member of the first lift cord routing mechanism. A second ladder tilt pulley can be attached to the second lift cord routing mechanism so that the second ladder tilt pulley is positioned above the first non-moving member of the second lift cord routing mechanism. Upper ends of rails of a first ladder can be attached to the first ladder tilt pulley and upper ends of rails of a second ladder can be attached to the second ladder tilt pulley so that the slats can be supported via the first and second ladders and rungs that extend between the rails of these ladders. In some embodiments, the lift cords can pass through the slats. In other embodiments, the lift cords may pass alongside the slats as they extend to a second rail (e.g. a bottom rail).

Other details, objects, and advantages of the window covering, window covering positional adjustment mechanism, and methods of making and using the same will become apparent as the following description of certain exemplary embodiments thereof proceeds.

BRIEF DESCRIPTION OF THE DRAWINGS

Exemplary embodiments of the window covering, window covering material tilt mechanism, and methods of making and using the same are shown in the accompanying drawings. It should be understood that like reference numbers used in the drawings may identify like components.

DETAILED DESCRIPTION OF EXEMPLARY EMBODIMENTS

Figure 1:
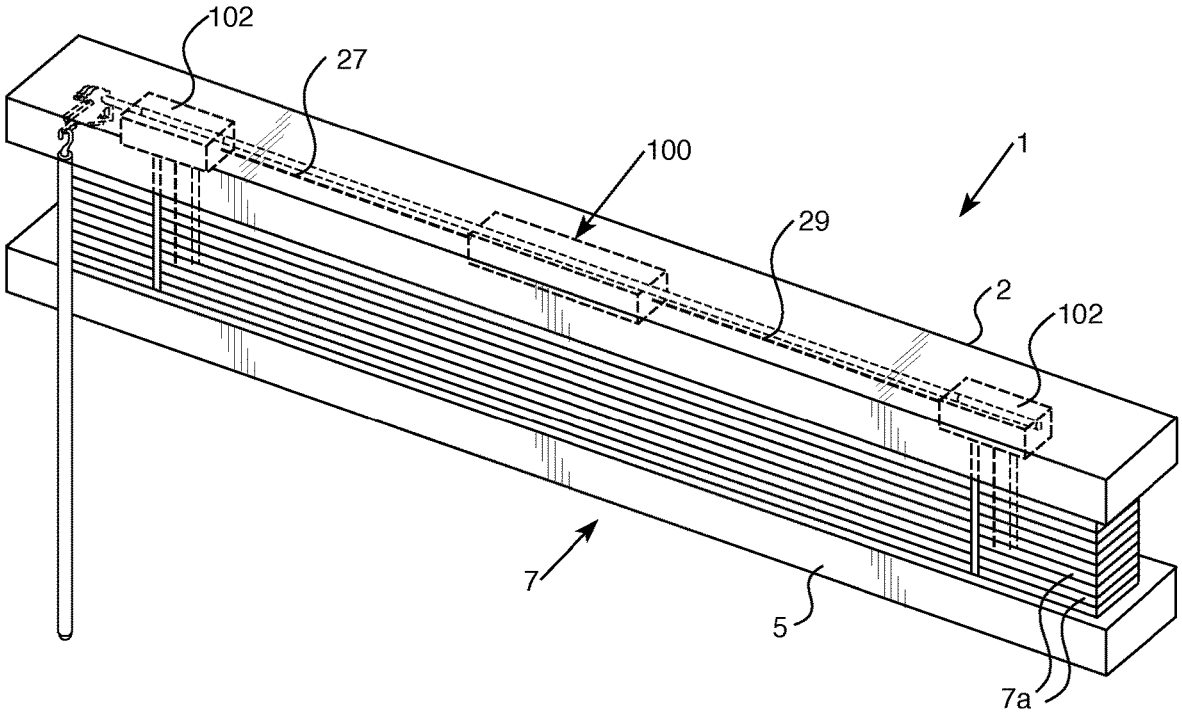
FIG. 1 is a perspective view of a first exemplary embodiment of my window covering in a retracted position.

As can be appreciated from FIGS. 1-10, embodiments of the window covering can include a height adjustment mechanism for controlling the raising and lowering of window covering material. Embodiments of the window covering can be configured to permit the window covering material to be raised and lowered without use of lift cords passing through a cord lock and/or without use of any exposed operator cord. Some embodiments may also be configured so that there is no exposed cord that a child could manipulate. Other embodiments may include one or more exposed cords, such as exposed lift cords or exposed venetian blind slat ladder cords or exposed venetian blind ladder tape.

Embodiments of the window covering 1 can include a first rail 2, a second rail 5, and window covering material 7 that is moveably attached to the first rail 3. In some embodiments, the first rail 3 can be configured as a headrail and the second rail 5 can be configured as a bottom rail. In embodiments of the window covering in which the window covering is configured as a top down bottom up shade, there may also be a third rail positioned above the first rail 3 such that the first rail is an intermediate rail and the upper third rail is a headrail.

The second rail 5 can be connected to the window covering material 7 and/or may be coupled to the first rail 3 such that the window covering material 7 and second rail 5 are moveable relative to the first rail. The window covering material 7 can be moveable between a fully lowered, or fully extended first position, and a fully retracted, or fully raised second position. The window covering material 7 can be connected to the first rail 3 via one or more lift cords that are coupled to a lift cord control mechanism 100 so that the window covering material 7 is adjustably positioned in any number of other positions between the fully raised and fully lowered positions. The second rail 5 can also be connected to the lift cord control mechanism to be moved relative to the first rail as the window covering material position is adjusted.

The lift cord control mechanism 100 can be considered a height adjustment mechanism for controlling the raising and lowering of window covering material 7 for at least some embodiments of the window covering 1. The lift cord control mechanism 100 can include a spring motor unit and lift cord routing mechanisms 102 located in the first rail 3. In other embodiments, the spring motor unit and the lift cord routing mechanisms 102 can be located in the second rail 5.

The window covering material 7 can be any type of suitable material, such as slats 7*a* on ladders, pleated material, cellular material, fabric material, non-woven fabric material, woven wood, woven bamboo, or other type of material. One or more lift cords may extend from the lift cord control mechanism 100 located within the first rail 3 through the window covering material 7 to connect the window covering material to the lift cord control mechanism 100. In some embodiments, the one or more lift cords may be directly connected to the window covering material. In other embodiments, the one or more lift cords may be pass through the window covering material 7 and also be connected to the second rail 5 and/or pass through the second rail 5 to facilitate a connection of the lift cord control mechanism 100 to the window covering material 7 and the second rail 5.

Some embodiments of the window covering 1 can include a first lift cord 27 and a second lift cord 29. Other embodiments may utilize more than two lift cords (e.g. three lift cords, four lift cords, five lit cords, 6 lift cords, etc.). Other embodiments, may utilize only one cord that is manipulated via one or more pulleys or other mechanism to route that cord to provide two runs, or lines, to function as multiple lift cords. For such an embodiment, the middle portion of the cord may be coupled to the lift cord control mechanism 100 and the terminal ends of the cord can be connected to different sides or adjacent different ends of the second rail 5 or a lower portion of the window covering material 7. Each lift cord may be a cord, a segment of a cord, a tape, a polymeric filament, or other type of flexible elongated member.

The window covering 1 can be configured so that each lift cord has a first portion coupled to a spring motor unit of the lift cord control mechanism 100 positioned in the first rail 2, a second portion that passes through the window covering material 7, and a third portion that is positioned in the second rail 5. The lift cords can be passed through the window covering material 7 so that motion of the one or more lift cords can result in retraction or extension of the window covering material to raise or lower the window covering. A user may grasp the window covering material 7, the second rail 5, or a handle connected to the second rail 5 or the window covering material 7 to provide a downward force that overcomes the force provided by one or more spring elements of the lift cord control mechanism to lower the window covering material 7 and second rail 5. This force provided by the user to lower the window covering drives motion of the lift cords to effect the lowering, or extension, of the window covering material 7 and the lowering of the second rail 5. To raise the window covering material 7 and second rail 5, a user may provide an upward force sufficient so that the force of one or more springs of the lift cord control mechanism 100 causes the lift cords to be moved to retract the window covering material 7 and second rail 5. When a user removes the force he or she has provided for raising or lowering the window covering, the lift cord control mechanism 100 can be configured to keep the lift cords stationary after the user has removed the applied force to maintain the window covering material 7 and the second rail 5 at the user selected position of the window covering material 7 and the second rail 5.

For venetian blind and mini blind embodiments of my window covering, a tilt mechanism 21 can be connected to the first rail and to a tilt shaft 23 positioned in the first rail 2. The tilt shaft 23 can be coupled to ladders 71 (e.g. ladders made of cord or tape that include front and rear rails and rungs extending between the front and rear rails, etc.) that retain slats 7*a*. Examples of tilt mechanisms that are usable in such embodiments of my window covering can be understood from U.S. patent application Ser. No. 15/659,943. The entirety of U.S. patent application Ser. No. 15/659,943 is incorporated by reference herein.

Embodiments of the window covering that have slats supported on ladders 71 can be configured so that the slats 7*a* are tiltable between open and closed positions in addition to being adjustable between raised and lowered positions, or retracted and extended positions. For instance, the window covering 1 can include slats 7*a* as its window covering material and can have a first ladders 71*a* positioned adjacent a first side of the window covering and a second ladders 71*b* positioned adjacent a second side of the window covering to support the slats that are suspended from the first rail 2 via the first and second ladders 71*a* and 71*b* and the lift cords. Such embodiments may utilize a tilt control mechanism 21 as previously mentioned herein. The slat tilt control mechanism can be operatively connected to the ladders 71 that support the slats to adjust the positions and/or orientations of the rails 72 and rungs 74 of the ladders to facilitate adjustment of the orientation of the slats between open and closed positions.

Figure 2:
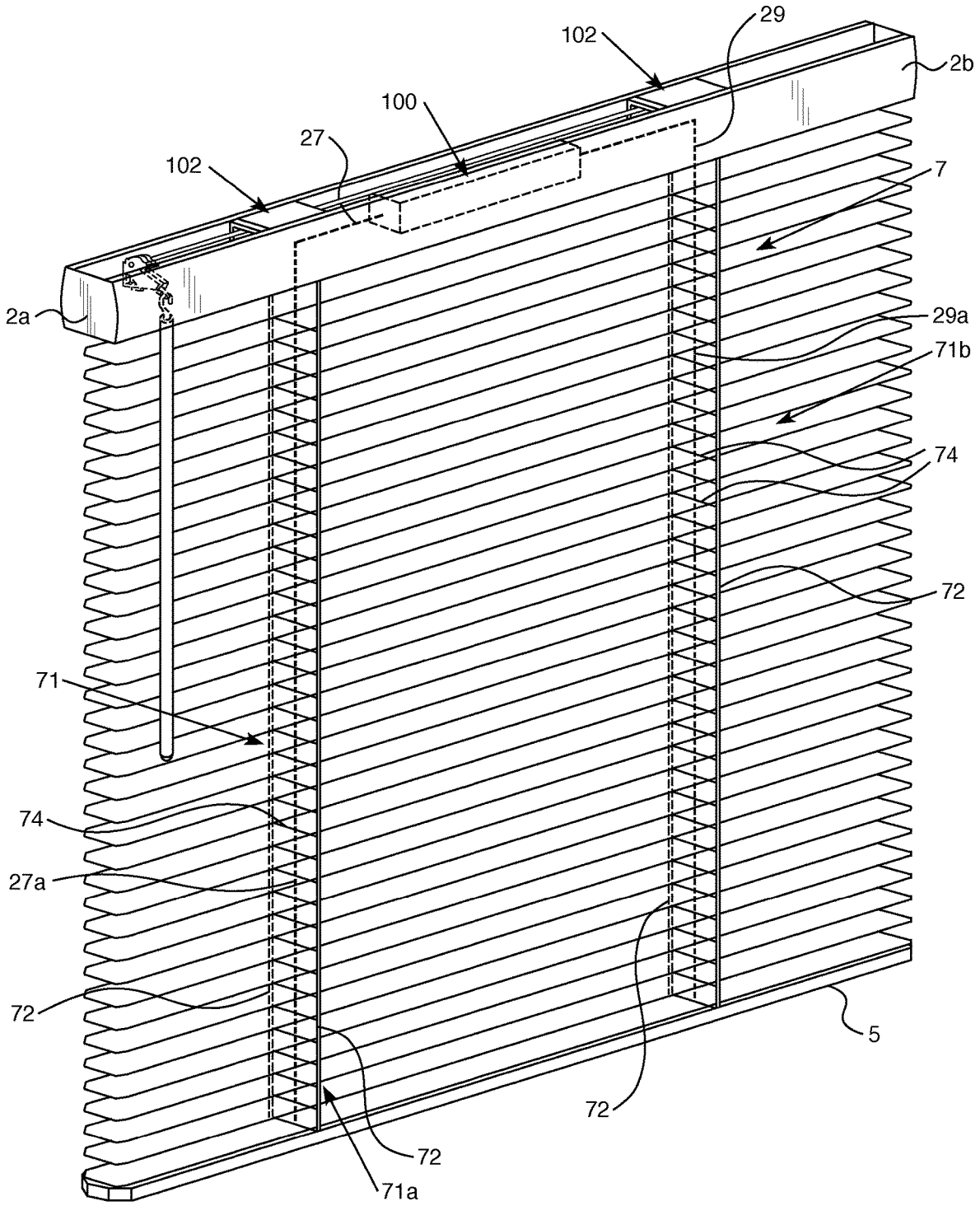
FIG. 2 is a perspective view of the first exemplary embodiment of my window covering in an extended position.

Each ladder 71 may have upper ends of the rails 72 of the ladders coupled to tilt shaft 23 or a ladder tilt pulley 231 coupled to a tilt shaft 23, for extending from the first rail 2 and supporting the slats 7*a*, which can also be called louvers. Rotation of the tilt shaft 23 via the tilt mechanism can cause the front and rear rails 72 of the ladders to move to adjust an orientation of the rungs 74 that extend between the rails from a horizontal orientation that corresponds to the slats being in an open position as shown in FIG. 2 to a closed position in which the rungs 74 are inclined or declined so that the slats 7*a* are in a tilted orientation so that upper and lower edges of the slats are positioned in contact with edges of immediately adjacent slats.

Figure 6:
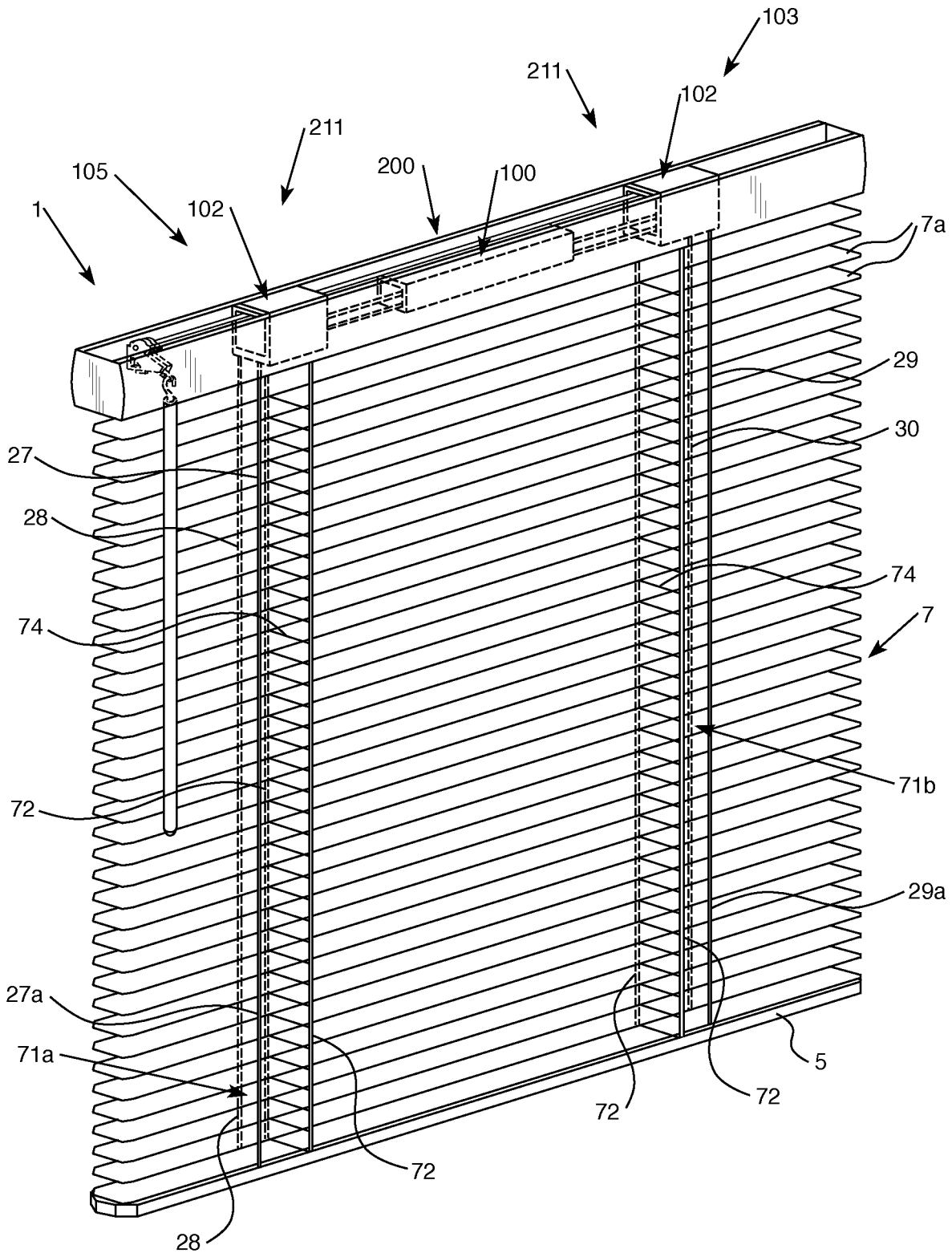
FIG. 6 is a perspective view of a second exemplary embodiment of my window covering in the extended position.
Figure 7:
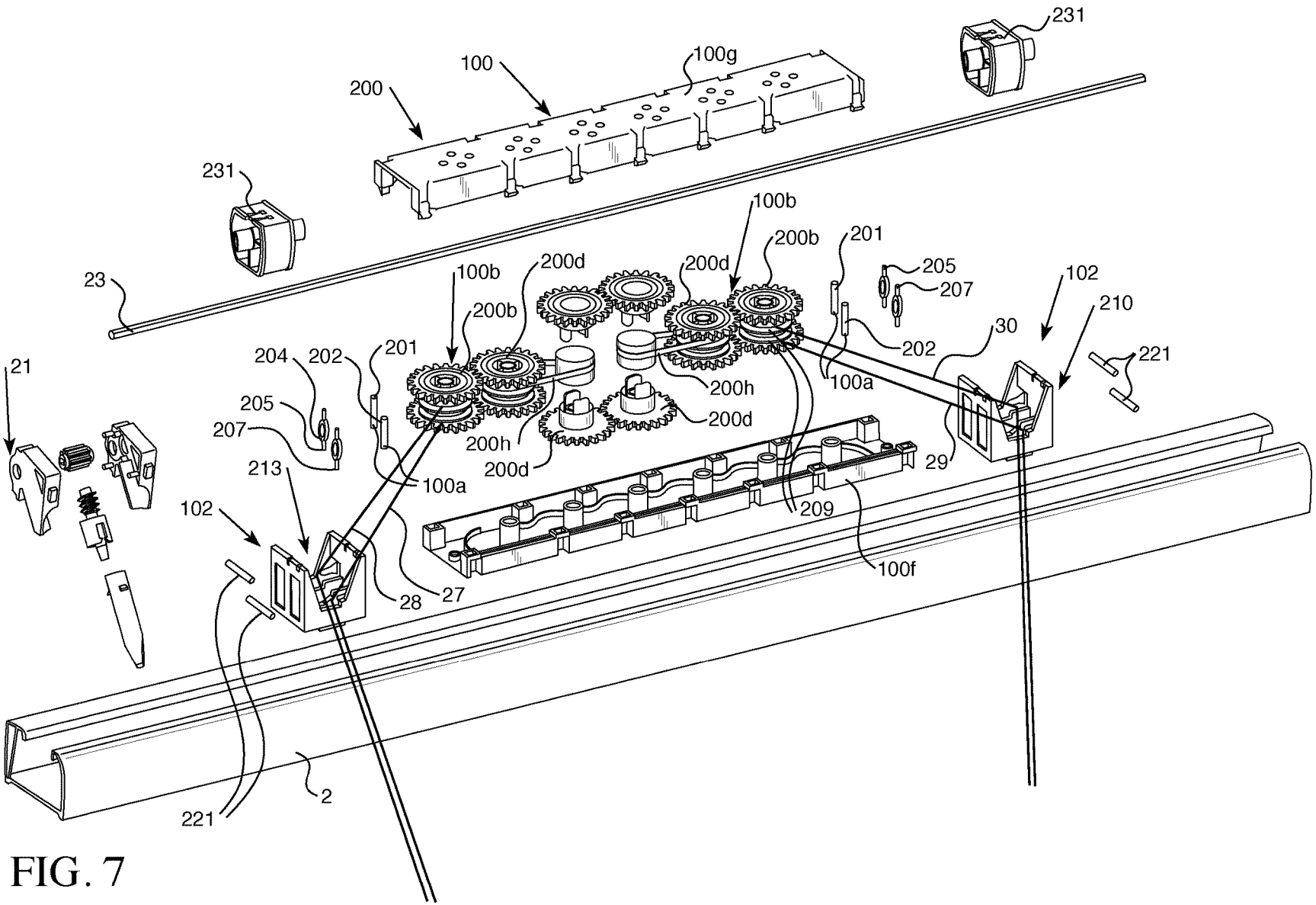
FIG. 7 is an exploded view of the second exemplary embodiment of my window covering that illustrates exemplary components of the lift cord control mechanism of my second exemplary embodiment of the window covering.
Figure 8:
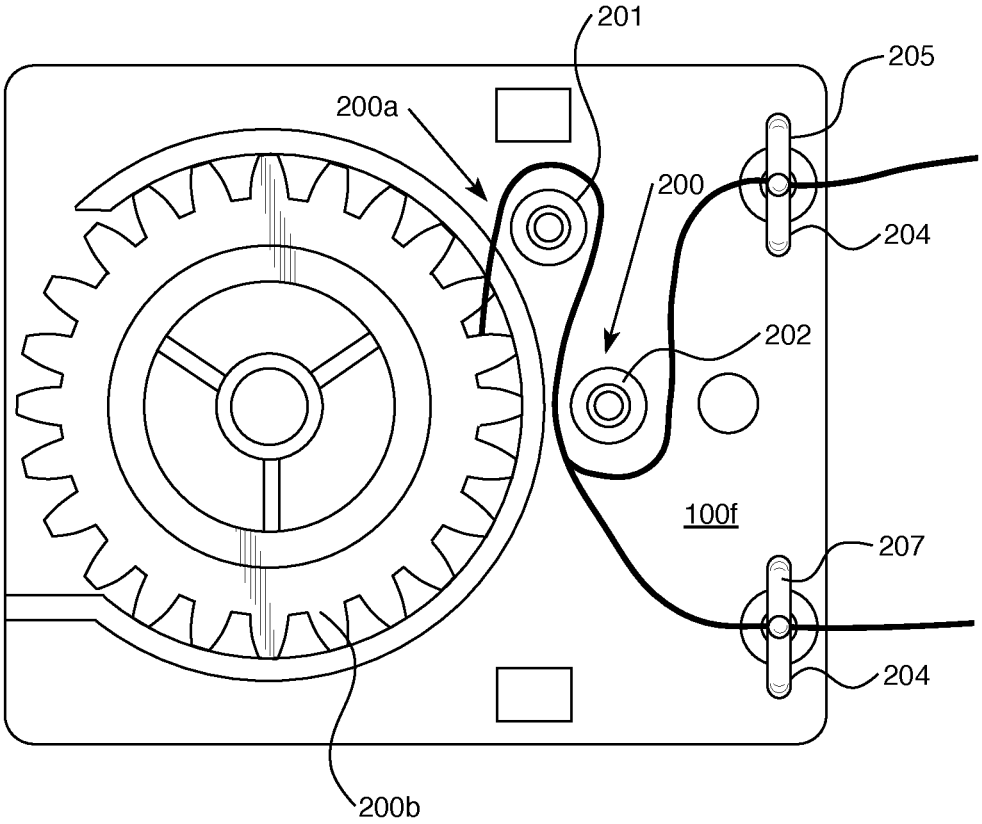
FIG. 8 is a fragmentary top view of the lift cord control mechanism of the second exemplary embodiment of my window covering.
Figure 9:
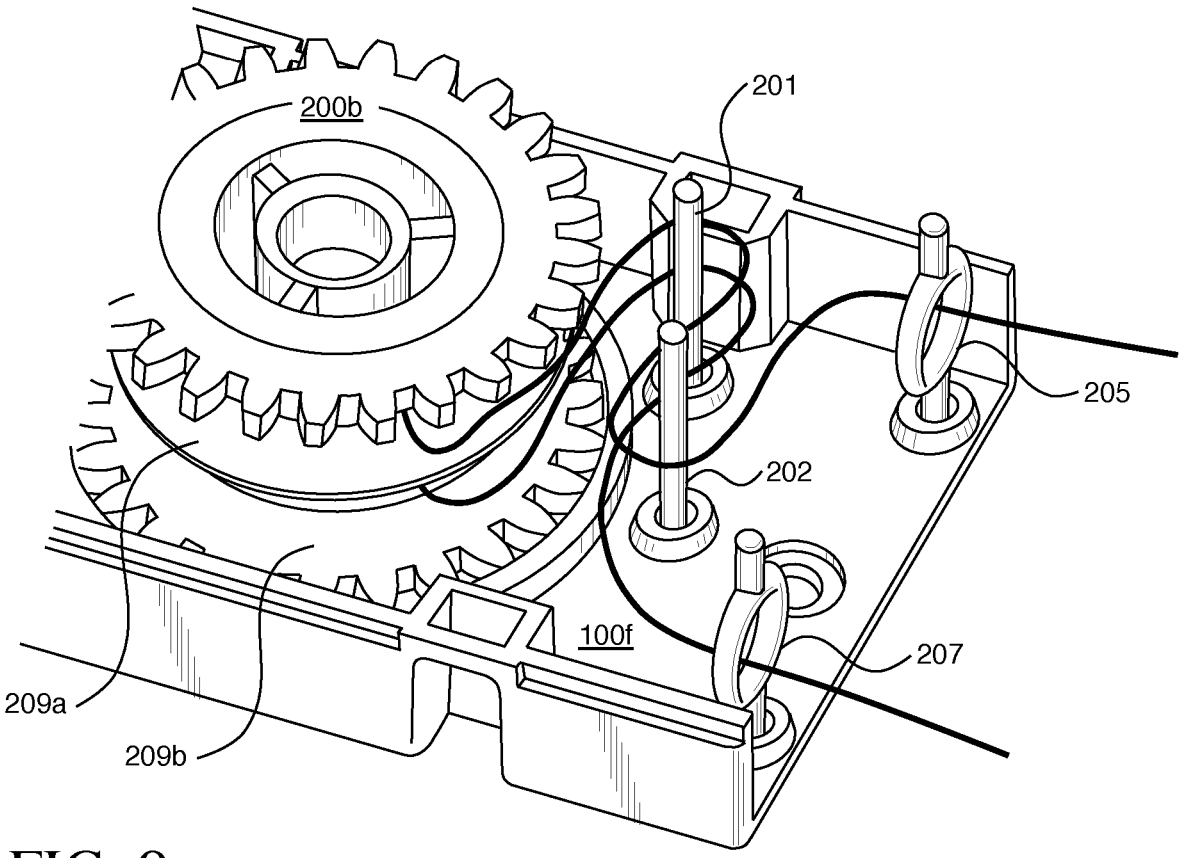
FIG. 9 is a perspective fragmentary view of the lift cord control mechanism of the second exemplary embodiment of my window covering.
Figure 10:
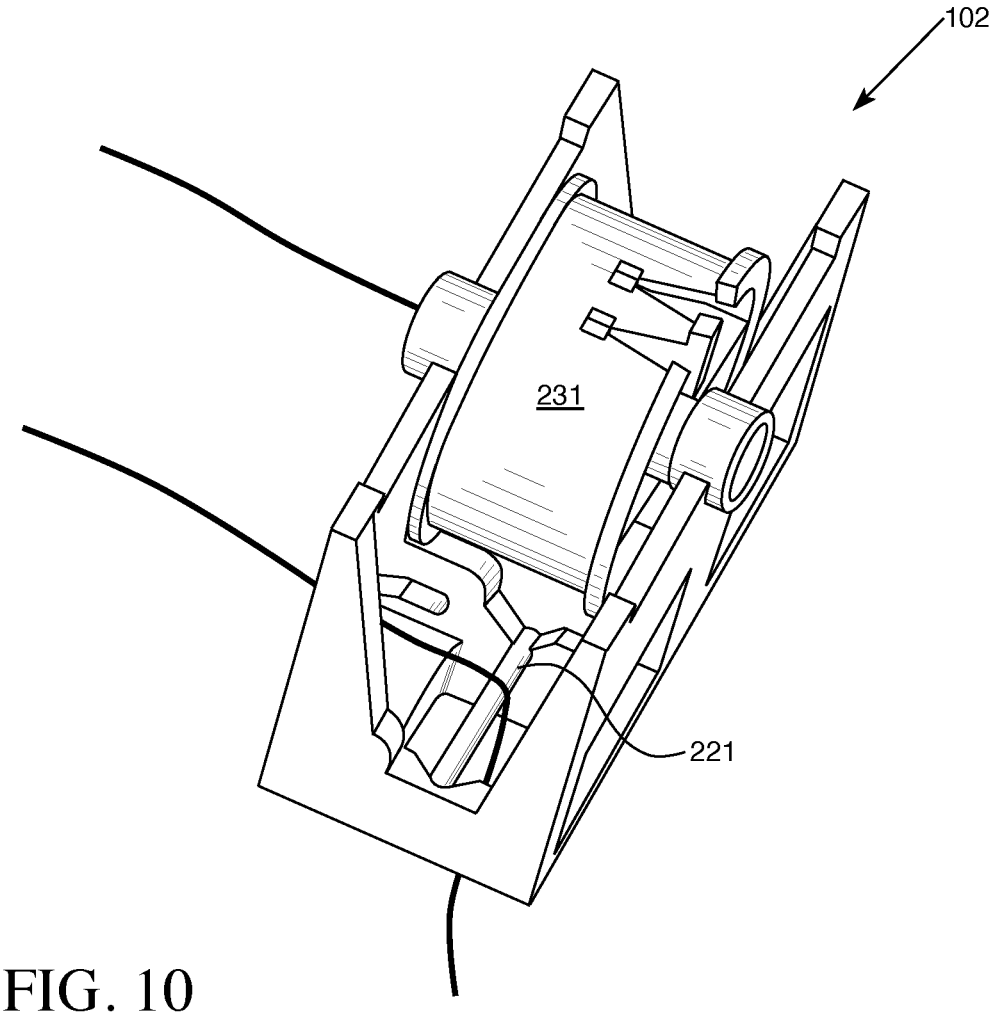
FIG. 10 is a perspective fragmentary of the lift cord control mechanism of the second exemplary embodiment of my window covering illustrating an exemplary cord routing mechanism utilized in the second exemplary embodiment of my window covering.

Each of the lift cords can be configured to pass between the front and rear rails 74 of a respective ladder 71 or may pass alongside or adjacent a respective ladder 71 when extending from the first rail 2 to the second rail 5 or a bottom portion of the window covering material (e.g. the bottom most slat). For instance, the first lift cord 27 can have a first segment 27*a* that extends from the first rail 3, through the slats between the front and rear rails 72 of a first ladder 71*a* that extend from a first ladder cord tilt pulley or tilt shaft 23 to the second rail 5. The second lift cord 29 can have a first segment 29*a* that extends from the first rail 3, through the slats between the front and rear rails 72 of a second ladder cord 71*b* that extend from a second ladder cord tilt pulley or tilt shaft 23 to the second rail 5. As another example, as shown in FIG. 6, the lift cords can extend from the first rail 2 to the window covering material 7 by passing alongside front or rear edges of the slats adjacent to a front or rear rail of a ladder 71. For such a lift cord route, the lift cords may not pass through any hole within any of the slats or may only pass through a recess or cut-out defined in outer edges of the slats 7*a*.

Figure 3:
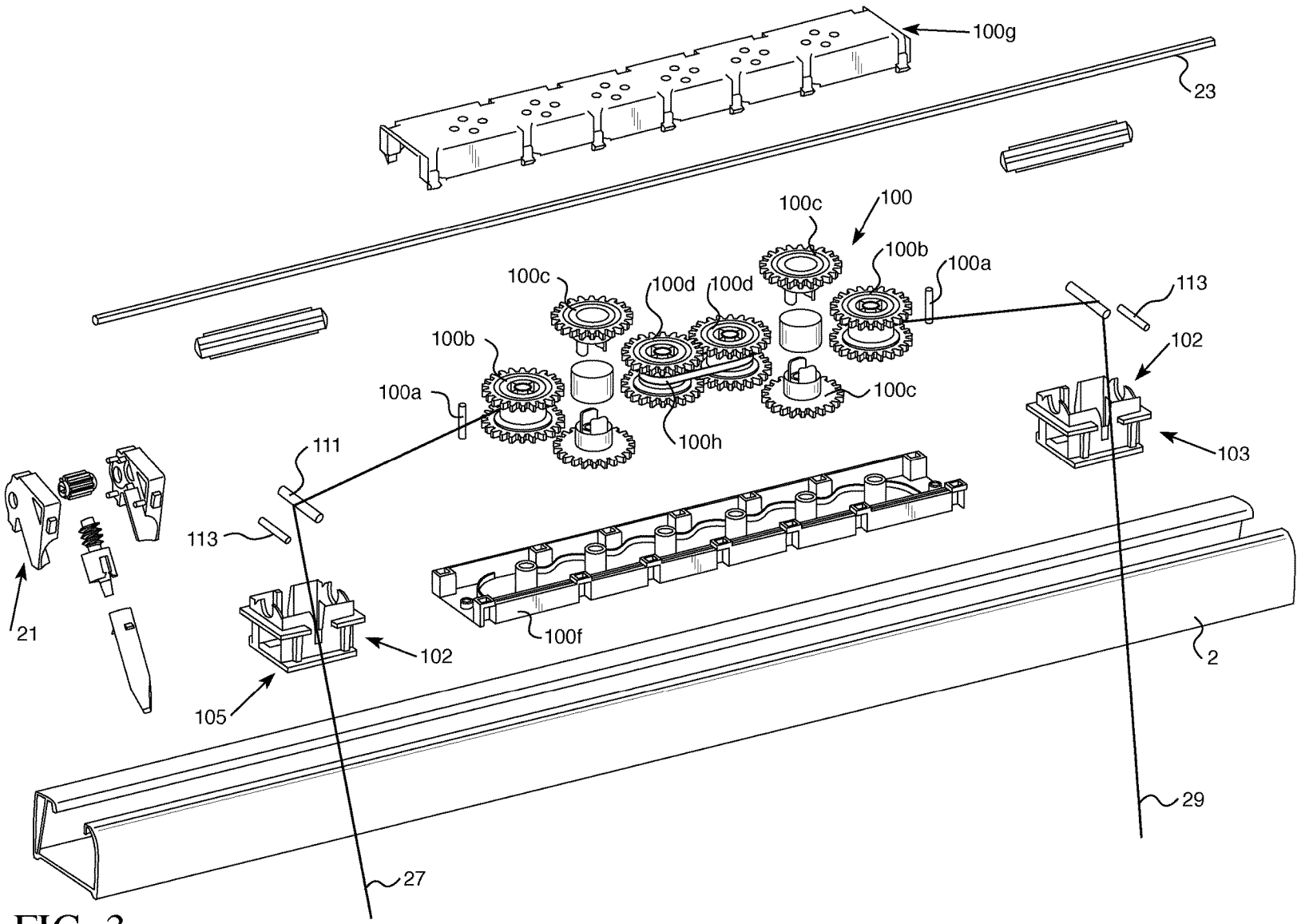
FIG. 3 is an exploded view of the first exemplary embodiment of my window covering that illustrates exemplary components of the lift cord control mechanism of this first exemplary embodiment.
Figure 4:
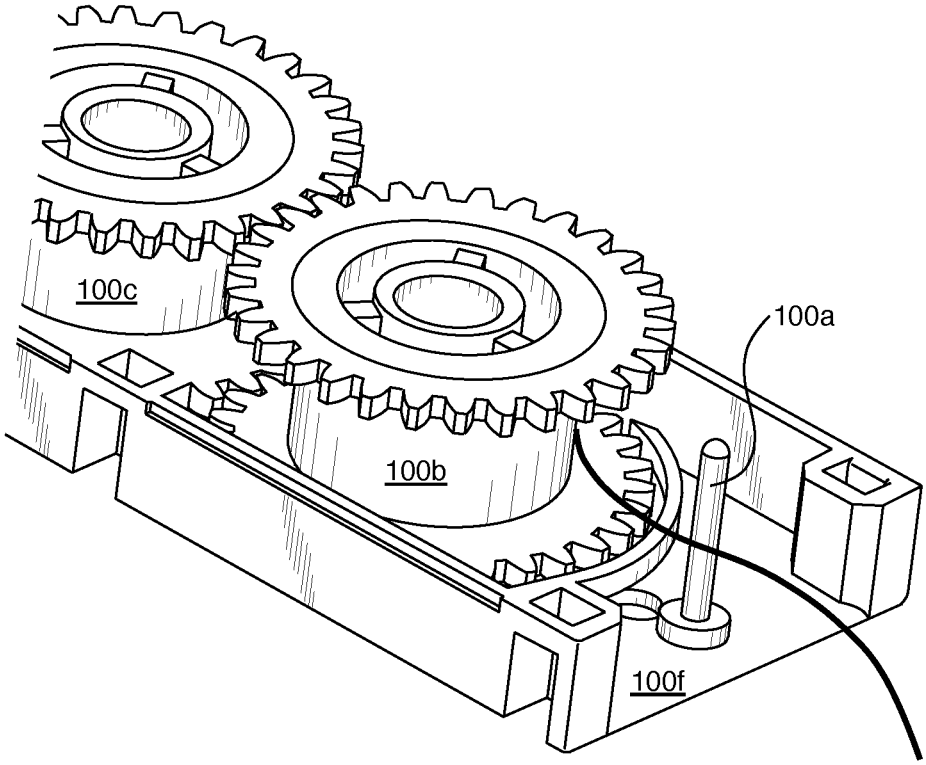
FIG. 4 is a perspective fragmentary view of the lift cord control mechanism of the first exemplary embodiment of my window covering.
Figure 5:
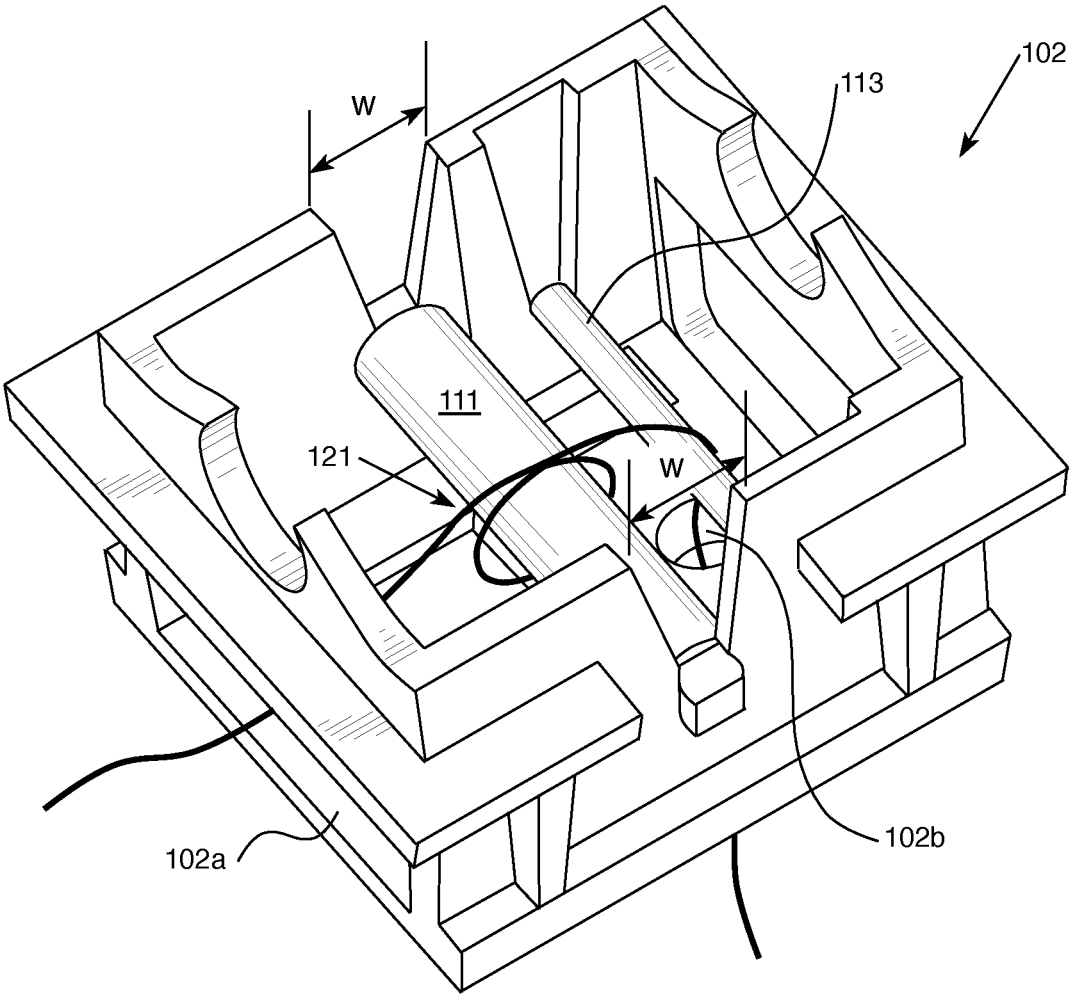
FIG. 5 is a perspective fragmentary of the lift cord control mechanism of the first exemplary embodiment of my window covering illustrating an exemplary cord routing mechanism utilized in the first exemplary embodiment of my window covering.

Referring to FIGS. 3-5, the lift cord control mechanism 100 can include a spring motor that includes spring motor pulleys 100*d* and at least one spring 100*h* that extends between the spring motor pulleys 100*d* such that each spring is moveable between these pulleys to adjust an amount of force exerted on the lift cords to maintain a position of the lift cords for maintaining a position of the window covering material 7 at a user selected position. Each of the spring motor pulleys 100*d* can be connected to a lift cord retention pulley 100*b* via a direct connection or via a connection to at least one intermediate pulley 100*c* that may have gear teeth that engage gear teeth of the lift cord retention pulley 100*b* and spring motor pulley 100*d* so that rotation of the spring motor pulley 100*d* drives rotation of the lift cord retention pulley 100*b* via rotation of the intermediate pulley 100*c*. For embodiments that may utilize more than two lift cords, the lift cord retention pulley 100*b* may be a double pulley or triple pulley that has a respective lift cord coupled within a respective groove of that pulley (e.g. two lift cords with each lift cord coupled within a respective groove of a double pulley, three lift cords with each lift cord coupled within a respective groove of a triple pulley, etc.).

The spring motor pulleys 100*d*, intermediate pulleys 100*c*, and lift cord retention pulleys 100*b* can be positioned within a housing having a housing bottom 100*f* and a housing top 100*g*. The housing can be configured to positioning the spring motor unit of the lift cord control mechanism within the first rail 2. The housing can have first and second ends that each define an opening through which one or more lift cords extend toward a lift cord routing mechanism 102. Each lift cord can extend from a respective lift cord retention pulley 100*b*, pass along a non-moving element 100*a* attached to the housing that extends from the housing bottom 100*f* so that the lift cord contacts the non-moving element 100*a* as the lift cord is unwound from the lift cord retention pulley 100*b* during window covering material extension and/or is wound upon the lift cord retention pulley 100*b* during window covering material retraction. Each lift cord may extend past a non-moving element 100*a* positioned by an opening in the spring motor housing through which the lift cord passes to a lift cord routing mechanism 102 positioned near an end of the first rail 2 prior to the lift cord passing out of the first rail 2 and through window covering material 7 to the second rail 5.

For instance, the first lift cord 27 can extend from a first lift cord retention pulley 100*b* toward a first end 2*a* of the first rail 2 to contact a first non-moving element 100*a* positioned in the spring motor housing. The first lift cord 27 can move along this non-moving element 100*a* as it is unwound from and/or wound upon the first lift cord retention pulley 100*b*. The first lift cord 27 can be routed so that it also contacts a first lift cord routing mechanism 105 that can include at least one nonmoving cord contacting element for routing the lift cord out of the first rail and through the window covering material 7. The first lift cord 27 can be routed via the non-moving lift cord routing elements connected to the spring motor housing and first lift cord routing mechanism 105 to increase the amount of friction that acts on the first lift cord when the first lift cord moves during extension and retraction of the window covering material 7 to provide an additional counterbalancing force to complement the force provided by at least one spring element 100*h* of the spring motor unit.

The second lift cord 29 can be routed similarly to the first lift cord 27, but be routed to extend in the first rail 2 in an opposite direction from the first lift cord 27. For example, the second lift cord 29 can extend toward a second end 2*b* of the first rail 2 that is opposite the first end 2*a* of the first rail 2 so that the second lift cord 29 extends from a second lift cord retention pulley 100*b* toward a second end 2*b* of the first rail 2 to contact a second non-moving element 100*a* positioned in the spring motor housing. The second lift cord 29 can move along this non-moving element 100*a* as it is unwound from and/or wound upon the second lift cord retention pulley 100*b*. The second lift cord 29 can be routed so that it also contacts a second lift cord routing mechanism 103 that can include at least one nonmoving cord contacting element for routing the lift cord out of the first rail 2 and through the window covering material 7. The second lift cord 29 can be routed via the non-moving lift cord routing elements connected to the spring motor housing and second lift cord routing mechanism 103 to increase the amount of friction that acts on the first lift cord when the second lift cord 29 moves during extension and retraction of the window covering material 7 to provide an additional counterbalancing force to complement the force provided by at least one spring element 100*h* of the spring motor unit. It should be appreciated that the supplemented force provided via the friction induced by the non-moving cord routing elements connected to the spring motor housing and non-moving cord routing elements connected to the lift cord routing mechanisms 102 (e.g. first and second lift cord routing mechanisms 103 and 105) can permit a lower strength spring element to be utilized in spring motor units for different sized window coverings, which can allow the window covering to be made at a lower cost. The added friction can also improve the responsiveness the lift cord control mechanism 100 has to the user removing a user applied force so that user adjustment of the window covering material can occur with more precision.

Each of the lift cord routing mechanisms 102 can be configured to permit the lift cord that is routed via that mechanism to be routed in different ways to provide a desired amount of friction on the motion of the lift cord during window covering material extension and retraction. For instance, each lift cord routing mechanism 102 can have a housing that defines a side opening 102*a* through which one or more lift cords pass into the housing, and a first non-moving member 111 and a second non-moving member 113 connected or defined in the housing or positioned in a chamber defined in the housing. The lift cord can be routed so that it forms at least one encirclement 121 about an outer circumference (or perimeter) of the first non-moving member 111 as shown in FIG. 5. The encirclement 121 can be from the lift cord being passed over and around the perimeter or circumference of the member about the width W of the first non-moving member 111 so that a segment of the lift cord crisscrosses over (e.g. if the crisscross is at a top of the member) or under (e.g. if the crisscross is at a bottom of the member) another segment of the lift cord contacting the non-moving member as the lift cord extends past the first non-moving member 111 to the second non-moving member 113. This criss-cross arrangement of the encirclement 121 can be considered as a formed loop around a periphery of the non-moving member. The lift cord can also contact the second non-moving member 113 so that it changes direction to pass through a hole 102*b* in the housing of the lift cord routing mechanism 102 that is aligned with a hole in the first rail 2 through which that lift cord passes as it extends out of the first rail to the window covering material 7. The second non-moving member 113 can be located below the first non-moving member 111 and can be positioned so that it is farther from the spring motor housing than the first non-moving member (or alternatively can be positioned below the first non-moving member 111 so that it is closer to the spring motor housing than the first non-moving member 111). The use of at least one encirclement 121 in the routing of the lift cord can help increase the amount of friction acting on the lift cord as it is moved during extension and retraction of the window covering material.

The lift cord control mechanism 100 can have other configurations for other embodiments that utilize different arrangements of non-moving elements, non-moving members, and spring motors. For instance, FIGS. 6-10 illustrate a second lift cord control mechanism arrangement 200 that can be used in other embodiments of my window covering. This arrangement can include a spring motor unit positioned in a spring motor housing having a housing top 100*g* and a housing bottom 100*f* that is configured to position the spring motor unit in the first rail 2. The spring motor housing has a first end and a second end that each define an opening through which multiple lift cords extend out of the spring motor housing toward a lift cord routing mechanism 102. The spring motor unit can include two spring motor assemblies that each includes two spring motor pulleys 200*d* and a spring element 100*h* that extends between the spring motor pulleys 200*d*. A first spring motor pulley 200*d* of the first spring motor can be connected to a first spring motor pulley 200*d* of a second spring motor to couple the spring motors together so that the spring motor pulleys 200*d* move synchronously during extension and retraction of the window covering material 7. The second spring motor pulley 200*d* of each spring motor can be directly connected to a lift cord retention pulley 200*b*. In yet other embodiments, one or more intermediate gears or pulleys having teeth can also be utilized for interconnecting spring motor pulleys and/or lift cord retention pulleys.

As may be appreciated from FIGS. 6-10, each lift cord retention pulley 200*b* can be structured as a double pulley that has multiple lift cord receiving grooves 209 so that each lift cord coupled to that pulley is wound and unwound about the pulley in a separate groove. For instance, a first lift cord retention pulley 200*b* can have multiple grooves so that the first lift cord 27 and a third lift cord 28 are in separate grooves that are separated by at least one side wall of the pulley so that each lift cord is wound and unwound from that pulley within its respective groove. As another example, a second lift cord retention pulley 200*b* that is located at an opposite end of the spring motor housing from the first lift cord retention pulley 200*b* can also be configured to define multiple grooves 209. The second lift cord 29 and a fourth lift cord 30 can be in separate grooves that are separated by at least one side wall of the second lift cord retention pulley 200*b* so that each lift cord is wound and unwound from that pulley within its respective groove. Gear teeth defined on the lift cord retention pulleys 200*b* and spring motor pulleys 200*d* (as well as any intermediary gears or pulleys that may be present) can interconnect the pulleys together so that the pulleys move synchronously during extension and retraction of the window covering material 7.

Each end of the spring motor housing in the second arrangement 200 can include a plurality of non-moving elements 102*a* or be connected to such elements (e.g. the ends of the housing bottom 100*f* and/or housing top 100*g* can be connected to such elements or the elements may be defined in the housing via molding of the housing or fabrication of the housing). These non-moving elements 200*a* can include, for example, rods, projections, protrusions, or bars and can also include annular structures 204. Each annular structure 204 can be a body that defines at least one hole therein through which a lift cord can pass. The hole can have any type of shape such as a circular, elliptical, triangular, diamond, rectangular, or other type of polygonal shape.

Each end of the spring motor housing can be connected to spaced apart non-moving elements 200*a* that include a first non-moving element 202 and a second non-moving element 201 that are affixed to the housing bottom 100*f* or otherwise positioned in the spring motor housing. Each end of the spring motor housing can be connected to multiple annular structures 204 such that these structures can be positioned adjacent the non-moving elements and be connected to the housing (e.g. by attachment to the spring motor housing bottom 100*f*). The annular structures 204 can include a first annular structure 205 and a second annular structure 207. The annular structures can be positioned closer to the end of the spring motor housing than the non-moving structures such that the non-moving elements 200*a* are located between the lift cord retention pulley 200*b* and the annular structures 204.

Lift cords wound within respective grooves 209 of a lift cord retention pulley 200*b* can include a lift cord within a first groove 209*a* and a lift cord within a second groove 209*b*. These grooves 209 may be separated and/or at least partially defined by a sidewall body of the lift cord retention pulley 200*b*. The lift cords may extend from their respective grooves to be routed via the non-moving elements 200*a* via the first and second spaced apart non-moving elements 201 and 202. Each lift cord may extend from the first non-moving element 201 to the second non-moving element 202. At the second-non-moving element 202, one lift cord can be routed to be passed through the hole of the first annular structure 205 and the other lift cord can be routed to be passed through the hole of the second annular structure 207. The first and second annular structures may be aligned with each other but may be spaced apart such that the first annular structure 205 is above or is forward of the second annular structure 207 (e.g. the first annular structure 205 is positioned closer to the front of the first rail than the second annular structure 207 or the first annular structure is positioned in the spring motor housing to be located above the second annular structure). The lift cords can be configured to move in different directions (e.g. vertically and horizontally or forwardly and sidewardly) as they move along the non-moving elements 200*a* and through their respective annular structures 204. The change in direction and contact with these elements and structures can increase the amount of friction acting on the lift cords as they move during extension and retraction of window covering material 7.

After each lift cord passes through a respective one of the annular structures 204, it can be routed to extend to a lift cord routing mechanism 102. For example, the first and third lift cords 27 and 28 can extend to a first lift cord routing mechanism 213 as they extend from a lift cord retention pulley toward a first end 2*a* of the first rail 2 and the second and fourth lift cords 29 and 30 can extend to a second lift cord routing mechanism 210 as the extend from a lift cord retention pulley toward the second end 2*b* of the second rail. Each lift cord can be routed to pass through a hole or other opening in a housing of the lift cord routing mechanism and pass along a non-moving member 221 attached to the housing of the lift cord routing mechanism 102 (e.g. defined in the shape of the mechanism or attached to the housing of the mechanism). In some embodiments, the non-moving members 221 attached to the lift cord routing mechanisms 102 can each be oriented to extend horizontally along their length and be positioned below a ladder tilt pulley 231 that is connectable to a tilt shaft 23. The ladder tilt pulley 231 can be configured for positioning in the housing of the lift cord routing mechanism 102.

Each non-moving member 221 can be aligned with a bottom hole defined in the lift cord routing mechanism housing, which can also be aligned with a hole in the first rail through which a lift cord passes as it extends from the first rail to window covering material 7. Each lift cord may contact a respective non-moving member 221 and change direction from moving substantially horizontally to moving vertically to pass from the lift cord routing mechanism to the window covering material via these holes. The change in direction and contact with the non-moving members can increase the amount of friction acting on the lift cords as they move during extension and retraction of window covering material 7.

The use of non-moving elements, non-moving members, and/or annular structure can route the lift cords within the first rail 2 as they extend from a lift cord retention pulley to which they are attached to the window covering material 7 so that a desired amount of friction is induced from movement of the lift cords along these non-moving bodies. This friction can provide a supplemental force to aid in the maintaining of a position of the window covering material at a user desired location. Such supplemental force can also help ensure that the user selected position is maintained quickly so that the window covering material does not move much, if at all, after a user has removed a force exerted on the window covering material and/or bottom rail 5 for lowering or raising the window covering material 7.

For instance, the first and third lift cords 27 and 28 can extend from a first lift cord retention pulley 200*b* toward a first end 2*a* of the first rail 2 to contact a first non-moving lift cord routing element 201 positioned in the spring motor housing and then contact a second lift cord routing element 202. The first and third lift cords 27 and 29 can move along these non-moving elements as they are unwound from and/or wound upon the first lift cord retention pulley 200*b*. From the second non-moving element 203, the first lift cord 27 can pass through a hole in a first annular structure 205 and the third lift cord 28 can pass through a hole in the second annular structure 207 that is spaced apart from the first annular structure. The first and third lift cords 27 and 28 can be routed so that extend out of their respective annular structures 204 toward a first lift cord routing mechanism 213 that can include multiple non-moving lift cord contacting members for routing the lift cords out of the first rail and 2 through the window covering material 7. For instance, the first and third lift cords 27 and 28 can each pass through a hole in the housing of the first lift cord routing mechanism 213 and contact with and move along a respective one of the non-moving members 221 as the lift cords move during extension and retraction of window covering material 7.

The second and fourth lift cords 29 and 30 can be routed similarly to the first and third lift cords 27 and 28, but be routed to extend in the first rail 2 in an opposite direction from the first and third lift cords 27 and 28. For example, the second lift cord 29 and the fourth lift cord 30 can extend toward a second end 2*b* of the first rail 2 that is opposite the first end 2*a* of the first rail 2 so that the second lift cord 29 and the fourth lift cord 30 each extends from a second lift cord retention pulley 200*b* toward a second end 2*b* of the first rail 2 to contact first and second non-moving lift cord routing elements 201 and 202 positioned in the spring motor housing. The second and fourth lift cords 29 can move along these non-moving elements as they are unwound from and/or wound upon the second lift cord retention pulley 200*b*. The second lift cord 29 and the fourth lift cord 30 can each be routed so that they extend form the second non-moving element 202 to a respective annular structure 204 positioned in the spring motor housing. For instance, the second lift cord 29 can be passed through a hole in a first annular structure 205 and the fourth lift cord 30 can be passed through a hole in the second annular structure 207 after they have contacted the second non-moving element 202. The second and fourth lift cords 29 and 30 can be routed so that they extend from their respective annular structure 204 toward the second lift cord routing mechanism 210 positioned near a second end 2*b* of the first rail 2 for contacting with a respective non-moving member 221 positioned in a housing of the second lift cord routing mechanism 210. The second and fourth lift cords 29 and 30 can each pass through a hole in the housing of the second lift cord routing mechanism 210 to contact a respective one of the non-moving members 221 positioned therein for moving along that member during extension and retraction of window covering material 7.

The friction provided by the routing of the first, second, third, and fourth lift cords 27-30 and the contact the lift cords have with non-moving elements 200*a*, annular structures 204, and non-moving members 221 help provide a supplemental force that can facilitate maintenance of the position of window covering material at a user desired location. Such friction can also permit smaller and/or weaker spring elements for spring motor units to be utilized to reduce the cost of making window coverings. The routing of the lift cords can also be configured to help keep the cords separated and avoid hang-up issues.

It should be appreciated that different embodiments of my window covering can utilize different arrangements of non-moving elements, non-moving members and/or annular structures and may or may not also include routing of lift cords so that there are one or more encirclements of a lift cord about such structure(s). Additionally, various other changes to embodiments of my window covering can be made to meet a particular set of design criteria. For instance, the window covering material can be any type of suitable material. The first rail 2 can be made of wood, bamboo, metal or other suitable material. The slats 7 of venetian blind and mini blind embodiments of my window covering can be composed of a polymeric material, wood, bamboo, or other type of suitable material. The second rail 5 can be structured as a bottom rail or other type of rail. The first rail 2 can be structured as a headrail or an intermediate rail of a top down bottom up window covering. The type of spring elements used in one or more spring motors of the spring motor unit can be an S-shaped spring or other type of spring. The spring elements can be structured as a constant force spring or variable force spring or have another type of spring member configuration. As yet another example, the pulleys of each spring motor and the lift cord retention pulleys can be structured in any of a number of suitable ways (e.g. structured to include gear teeth or not include such teeth, be structure for use in connection with a transmission mechanism, can each be structured as a single pulley, double pulley, or triple pulleys or other type of pulley, etc.).

As yet another example, the non-moving elements and non-moving members of lift cord routing mechanisms 102 that are configured for contacting one or more lift cords during motion of the lift cords that occurs when window covering material is extended or retracted can be any type of structure that is configured so that those structures do not rotate or otherwise move within a rail in which they are positioned when the window covering is mounted adjacent a window and is usable by a user as a height adjustable cover for a window. The position of these non-moving elements may be a fixed location within a rail after a window covering is mounted and the rail is no longer moved for transport or installation of the window covering. For example, the non-moving elements can include posts, rods, bars, annular structures that are positioned so that they do not rotate or slide and do not move linearly within a rail and do not move dynamically within a rail when a window covering is mounted, structure defined within a spring motor housing, structure affixed (e.g. welded, adhered, fastened, etc.) within a rail or a housing positioned in a rail such as one or more rods, bars, annular structures, posts, and/or other type of element. The non-moving elements may be positioned in the rail so that they are non-moving relative to the rail when the window covering is in use by a user (e.g. they only move if the rail in which they are positioned are moved). As another example, the non-moving members can be posts, rods, or bars that are positioned so that they do not rotate and do not move linearly within a rail or a housing positioned in a rail after the window covering is mounted. The non-moving members may be positioned in the rail so that they are non-moving relative to the rail when the window covering is in use by a user (e.g. they only move if the rail in which they are positioned are moved).

It should also be appreciated that some components, features, and/or configurations may be described in connection with only one particular embodiment, but these same components, features, and/or configurations can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments can be combined together in any manner and such combinations are expressly contemplated and disclosed by this statement. Therefore, while certain exemplary embodiments of window covering 1, lift cord control mechanism 100, and methods of making and using the same have been shown and described above, it is to be distinctly understood that the invention is not limited thereto but may be otherwise variously embodied and practiced within the scope of the following claims.

What is claimed is:

1. A window covering comprising:

a first rail;

a lift cord control mechanism positioned in the first rail, the lift cord control mechanism having a housing, a first lift cord retention pulley positioned in the housing, the first lift cord retention pulley having multiple grooves, the multiple grooves including a first groove and a second groove, a second lift cord retention pulley also positioned in the housing;

a first lift cord extending from the first groove of the first lift cord retention pulley;

a second lift cord extending from the second lift cord retention pulley;

a third lift cord extending from the second groove of the first lift cord retention pulley;

a spring motor connected to the first lift cord retention pulley and the second lift cord retention pulley, the spring motor comprising at least one spring motor pulley positioned between the first lift cord retention pulley and the second lift cord retention pulley within the housing such that the first lift cord retention pulley is positioned adjacent a first end of the housing and the second lift cord retention pulley is positioned adjacent a second end of the housing; and a first non-moving element positioned in the housing between the first end of the housing and the first lift cord retention pulley, the first non-moving element contacting the first lift cord that extends from the first groove of the first lift cord retention pulley and the third lift cord that extends from the second groove of the first lift cord retention pulley;

a second non-moving element positioned in the housing between the first end of the housing and the first lift cord retention pulley such that the second non-moving element is closer to the first end of the housing than the first non-moving element, the second non-moving element contacting the first lift cord that extends from the first groove of the first lift cord retention pulley and the third lift cord that extends from the second groove of the first lift cord retention pulley;

a first annular structure connected to the housing adjacent the first end of the housing, the first annular structure positioned such that the first annular structure is located between a first lift cord routing mechanism and the first non-moving element, the first lift cord passing through a hole in the first annular structure;

a second annular structure connected to the housing adjacent the first end of the housing, the second annular structure positioned such that the second annular structure is located between the first lift cord routing mechanism and the first non-moving element, the third lift cord passing through a hole in the second annular structure;

the first annular structure and the second annular structure spaced apart from each other within the housing adjacent the first end of the housing such that the first lift cord extends from the second non-moving element to the first annular structure in a first direction and the third lift cord extends from the second non-moving element to the second annular structure in a second direction, the second direction differing from the first direction.

2. The window covering of claim 1, wherein:

the first lift cord routing mechanism is positioned in the first rail adjacent a first end of the first rail, the first lift cord routing mechanism having a first non-moving member that contacts the first lift cord such that the first lift cord moves along the first non-moving member when the window covering material is extended or retracted.

3. The window covering of claim 2, wherein the first annular structure is positioned above the second annular structure within the housing; and the first non-moving element and the second non-moving element are positioned so that the first lift cord moves along a sinuous path between the first non-moving element and the first annular structure when the window covering material is extended or retracted and the third lift cord moves along a sinuous path between the first non-moving element and the second annular structure when the window covering material is extended or retracted.

4. The window covering of claim 2, wherein the first direction differs from the second direction due to differing vertical paths of motion.

5. The window covering of claim 4, wherein the third lift cord contacts a second non-moving member of the first lift cord routing mechanism such that the second lift cord moves along the second non-moving member when the window covering material is extended or retracted.

6. The window covering of claim 1, wherein:

the first lift cord is positioned adjacent a first non-moving member of the first lift cord routing mechanism such that the first lift cord forms a first encirclement about the first non-moving member.

7. The window covering of claim 6, comprising:

a second non-moving member of the first lift cord routing mechanism, the first lift cord contacting the second non-moving member such that the first lift cord moves along the second non-moving member when the window covering material is extended or retracted.

8. The window covering of claim 7, wherein the second non-moving member is below the first non-moving member in the first rail.

9. The window covering of claim 1, wherein the window covering material is comprised of a plurality of slats on ladders that are coupled to a tilt shaft positioned in the first rail.

10. A window covering comprising:

a first rail;

a lift cord control mechanism positioned in the first rail, the lift cord control mechanism comprising at least one spring motor connected between a first lift cord retention pulley and a second lift cord retention pulley;

a first lift cord that extends from the first lift cord retention pulley, the first lift cord extending from a first groove of the first lift cord retention pulley to window covering material;

a second lift cord that extends from a first groove of the second lift cord retention pulley, the second lift cord extending from the second lift cord retention pulley to the window covering material;

a third lift cord that extends from a second groove of the first lift cord retention pulley to window covering material;

a fourth lift cord that extends from a second groove of the second lift cord retention pulley to window covering material;

a first non-moving element positioned in the first rail adjacent the first lift cord retention pulley such that the first lift cord and the third lift cord contact the first non-moving element and move along the first non-moving element during retraction and extension of the window covering material; and a second non-moving element positioned in the first rail adjacent the second lift cord retention pulley such that the second lift cord and the fourth lift cord contact the second non-moving element and move along the second non-moving element during retraction and extension of the window covering material;

a first lift cord routing mechanism having a first non-moving member that contacts the first lift cord such that the first lift cord moves along the first non-moving member of the first lift cord routing mechanism when the window covering material is extended or retracted;

a second lift cord routing mechanism having a first non-moving member that contacts the second lift cord such that the second lift cord moves along the first non-moving member of the second lift cord routing mechanism when the window covering material is extended or retracted;

a third non-moving element positioned such that the third non-moving element is closer to the first lift cord routing mechanism than the first non-moving element, the third non-moving element contacting the first lift cord that extends from the first groove of the first lift cord retention pulley and the third lift cord that extends from the second groove of the first lift cord retention pulley;

a first annular structure positioned such that the first annular structure is located between the first lift cord routing mechanism and the first non-moving element, the first lift cord passing through a hole in the first annular structure;

a second annular structure positioned such that the second annular structure is located between the first lift cord routing mechanism and the first non-moving element, the third lift cord passing through a hole in the second annular structure;

the first annular structure and the second annular structure spaced apart from each other such that the first lift cord extends from the third non-moving element to the first annular structure in a first direction and the third lift cord extends from the second non-moving element to the second annular structure in a second direction, the second direction differing from the first direction.

11. The window covering of claim 10, wherein:

the first non-moving element and the third non-moving element are positioned so that the first lift cord moves along a sinuous path between the first non-moving element and the first annular structure when the window covering material is extended or retracted and the third lift cord moves along a sinuous path between the first non-moving element and the second annular structure when the window covering material is extended or retracted;

the first lift cord routing mechanism is positioned in the first rail adjacent a first end of the first rail; and the second lift cord routing mechanism is positioned in the first rail adjacent a second end of the first rail.

12. The window covering of claim 10, comprising:

a third annular structure positioned such that the third annular structure is located between the second lift cord routing mechanism and the second non-moving element, the second lift cord passing through a hole in the first annular structure; and a fourth annular structure positioned such that the fourth annular structure is located between the second lift cord routing mechanism and the second non-moving element, the fourth lift cord passing through a hole in the second annular structure.

13. The window covering of claim 12, comprising:

a fourth non-moving element positioned such that the fourth non-moving element is closer to the second lift cord routing mechanism than the second non-moving element, the fourth non-moving element contacting the second lift cord that extends from the first groove of the second lift cord retention pulley and the fourth lift cord that extends from the second groove of the second lift cord retention pulley;

the third annular structure and the fourth annular structure are spaced apart from each other such that the second lift cord extends from a fourth non-moving element to the third annular structure in a third direction and the fourth lift cord extends from the fourth non-moving element to the fourth annular structure in a fourth direction, the third direction differing from the fourth direction.

14. The window covering of claim 13, wherein:

the third lift cord also contacts a second non-moving member of the first lift cord routing mechanism such that the third lift cord moves along the second non-moving member of the first lift cord routing mechanism when the window covering material is extended or retracted; and the fourth lift cord also contacts a second non-moving member of the second lift cord routing mechanism such that the fourth lift cord moves along the second non-moving member of the second lift cord routing mechanism when the window covering material is extended or retracted.

15. The window covering of claim 10, wherein:

the first lift cord positioned adjacent the first non-moving member of the first lift cord routing mechanism such that the first lift cord forms a first encirclement about the first non-moving member of the first lift cord routing mechanism; and the second lift cord positioned adjacent the first non-moving member of the second lift cord routing mechanism such that the second lift cord forms a first encirclement about the first non-moving member of the second lift cord routing mechanism.

16. The window covering of claim 15, comprising:

a second non-moving member of the first lift cord routing mechanism, the first lift cord contacting the second non-moving member of the first cord routing mechanism such that the first lift cord moves along the second non-moving member of the first cord routing mechanism when the window covering material is extended or retracted; and a second non-moving member of the second lift cord routing mechanism, the second lift cord contacting the second non-moving member of the second cord routing mechanism such that the second lift cord moves along the second non-moving member of the second cord routing mechanism when the window covering material is extended or retracted.

17. The window covering of claim 16, wherein:

the second non-moving member of the first cord routing mechanism is below the first non-moving member of the first cord routing mechanism in the first rail; and the second non-moving member of the second cord routing mechanism is below the first non-moving member of the second cord routing mechanism in the first rail.

18. The window covering of claim 10, wherein the window covering material is comprised of a plurality of slats on ladders that are coupled to a tilt shaft positioned in the first rail.

19. The window covering of claim 18, wherein:

the first lift cord routing mechanism is positioned in the first rail adjacent a first end of the first rail;

the second lift cord routing mechanism positioned in the first rail adjacent a second end of the first rail;

a first ladder tilt pulley attached to the first lift cord routing mechanism, the first ladder tilt pulley positioned above the first non-moving member of the first lift cord routing mechanism;

a second ladder tilt pulley attached to the second lift cord routing mechanism, the second ladder tilt pulley positioned above the first non-moving member of the second lift cord routing mechanism; and wherein upper ends of rails of a first ladder of the ladders is attached to the first ladder tilt pulley and upper ends of rails of a second ladder of the ladders is attached to the second ladder tilt pulley.

20. The window covering of claim 19, wherein the first lift cord passes through the slats and the second lift cord passes through the slats.

* * * * *